US010975566B2

(12) United States Patent
Kropac et al.

(10) Patent No.: US 10,975,566 B2
(45) Date of Patent: Apr. 13, 2021

(54) CURTAIN WALL SYSTEM AND PANEL SUPPORT ASSEMBLY THEREFOR

(71) Applicant: OLDCASTLE BUILDINGENVELOPE CANADA INC., Mississauga (CA)

(72) Inventors: Kamil Kropac, Caledon (CA); Oleksandr Gerashchenko, Bolton (CA); Leszek Szczepanski, Oakville (CA)

(73) Assignee: OLDCASTLE BUILDING PRODUCTS CANADA, INC., Saint John (CA)

( * ) Notice: Subject to any disclaimer, the term of this patent is extended or adjusted under 35 U.S.C. 154(b) by 0 days.

(21) Appl. No.: 16/583,890

(22) Filed: Sep. 26, 2019

(65) Prior Publication Data

US 2020/0102739 A1 Apr. 2, 2020

Related U.S. Application Data

(60) Provisional application No. 62/738,105, filed on Sep. 28, 2018.

(51) Int. Cl.
*E04B 2/96* (2006.01)
*E04B 2/90* (2006.01)

(52) U.S. Cl.
CPC ..... *E04B 2/967* (2013.01); *E04B 2/90* (2013.01); *E04B 2/96* (2013.01)

(58) Field of Classification Search
CPC ..... E04B 2/96; E04B 2/90; E04B 2/88; E04B 2/967; E06B 3/267; E06B 3/26336;
(Continued)

(56) References Cited

U.S. PATENT DOCUMENTS 4,377,926 A * 3/1983 Coulston ..... E04B 2/96 49/DIG. 1
4,428,171 A * 1/1984 Harbin ..... E04B 2/965 49/DIG. 1

(Continued)

OTHER PUBLICATIONS

Oldcastle Glass Engineered Products 6100-5 Series FULWAL IV Curtainwall System Standard Capped Details Booklet, 17 pages, Mar. 30, 2009.

(Continued)

*Primary Examiner* — Jessie T Fonseca
(74) *Attorney, Agent, or Firm* — Mintz Levin Cohn Ferris Glovsky and Popeo, P.C.; Steven M. Jensen

(57) ABSTRACT

A curtain wall system for a building structure, comprising: a frame structure with a plurality of wall panels secured thereto to define an outer building structure wall; a plurality of supporting chair members extending laterally away from a corresponding frame member of the frame structure for receiving a corresponding wall panel, each chair member being sufficiently rigid for supporting the corresponding wall panel in a cantilevered configuration relative to the corresponding frame member, each supporting chair member having an appendage connector located at a distal side end thereof; and an exterior appendage member having a distal chair connector for engaging the appendage connector of at least one supporting chair member to attach the appendage member to the at least one supporting chair member such that the exterior appendage member extends away from the at least one supporting chair member and towards the exterior of the building structure.

25 Claims, 6 Drawing Sheets

(58) Field of Classification Search
CPC ..... E06B 3/66; E06B 3/5418; E06B 3/64; E06B 2003/26392; Y10S 49/01
See application file for complete search history.

(56) References Cited

U.S. PATENT DOCUMENTS

| | | | | | |
|---|---|---|---|---|---|
| 4,672,784 | A * | 6/1987 | Pohlar | E04B 2/96 | 52/209 |
| 4,680,905 | A * | 7/1987 | Rockar | E04D 3/08 | 52/200 |
| 2002/0124499 | A1* | 9/2002 | Braybrook | E04B 2/96 | 52/235 |
| 2006/0070342 | A1* | 4/2006 | Ferro | E04B 2/96 | 52/745.09 |
| 2015/0284951 | A1* | 10/2015 | Frederick | E04B 2/90 | 52/235 |
| 2016/0053487 | A1* | 2/2016 | Frederick | E04B 2/96 | 52/235 |
| 2016/0145933 | A1* | 5/2016 | Condon | E06B 3/66 | 52/204.5 |
| 2017/0022708 | A1* | 1/2017 | Dolby | E04B 2/90 | |
| 2019/0078380 | A1* | 3/2019 | McKenna | E06B 7/2303 | |

OTHER PUBLICATIONS

Oldcastle Glass Engineered Products FULWAL IV: 4 Sided Capped Assembly Instructions, 29 pages, Dec. 2, 2008.
Oldcastle BuildingEnvelope 6500 Series Arctic Curtain Wall Standard System Details, 42 pages, May 31, 2017.
Oldcastle BuildingEnvelope 6500 Series Arctic Curtain Wall Guideline Manual, 27 pages, Jun. 2017.
Kawneer 2500 UT Unitwall System, 24 pages, Jul. 2015.

* cited by examiner

CURTAIN WALL SYSTEM AND PANEL SUPPORT ASSEMBLY THEREFOR

CROSS-REFERENCE TO RELATED APPLICATIONS

The present claims priority from U.S. Provisional Patent Application No. 62/738,105 filed on Sep. 28, 2018, the specification of which is incorporated herein by reference.

TECHNICAL FIELD

The technical field generally relates to curtain wall systems, and more particularly to panel support assemblies for curtain wall systems.

BACKGROUND

Curtain wall systems are used to form non-structural outer walls for building structure. A curtain wall system typically includes a frame structure and a plurality of relatively lightweight panels such as glass panels secured vertically to the frame structure.

Different systems have been proposed to secure the panels to the frame structure. According to one system, each horizontal frame members includes a "nose" portion which generally consists of a support panel which projects away from the horizontal members and towards the exterior of the building. The nose portion is adapted to receive and support the glass panel in a cantilevered configuration.

In some systems, the glass panel may further be sandwiched between the horizontal frame member and a vertically-extending pressure plate which is adapted to be attached to the nose panel using mounting screws. Typically, a cap member is further clipped over the pressure plate to hide the pressure plate and mounting screws. In this system, the nose portion is integrally formed with the horizontal frame member to define a rigid support for the glass panel.

In an alternative system, the nose portion is instead provided as a separate element from the horizontal frame member. In this system, the nose portion is connected to the horizontal frame member by a thermal break member made of a material with relatively low thermal conductivity to prevent thermal transfer by conduction through the nose portion from the exterior of the building to the horizontal frame member. In this case, the glass panel can instead be supported by a chair member which extends generally horizontally above the nose portion and which is distinct from the nose portion.

In yet another system, the glass panel is supported by a chair member connected to the horizontal frame member and the cap member is connected to a dedicated cap clip member which is distinct from the frame structure and from the chair member. Specifically, the cap clip member is connected to the horizontal frame member and extends from the horizontal frame member below the chair member and beyond the chair member to connect with the cap member.

Unfortunately, the systems above require multiple parts to structurally hold the glass panel and to hold the cap member and may therefore be relatively expensive and complex to manufacture and assemble.

In yet another system, the glass panel may be supported by a chair member extending from the horizontal frame member and be secured in place using silicone glazing sealant, which simultaneously serves as a sealant and an adhesive. Specifically, the silicone glazing sealant may be provided between the glass panel and the horizontal frame member to thereby secure the glass panel to the horizontal frame member. Additional silicone glazing sealant may be used to seal the gap around the chair member and between the glass panel and other glass panels located directly above and below the glass panel. Unfortunately, this system does not provide means for exterior appendages such as decorative cap members, sunshades or other features and ornaments to be secured to the building structure.

There is therefore a need for a curtain wall system which may alleviate or overcome at least one of the above-identified drawbacks.

SUMMARY

According to one aspect, there is provided a curtain wall system for a building structure, the system comprising: a frame structure connectable to an outer perimeter of the building structure, the frame structure including a plurality of frame members secured to each other; a plurality of wall panels securable to the frame structure side-by-side and parallel to each other so as to define an outer wall for the building structure when the frame structure is connected to the building structure; a plurality of supporting chair members extending laterally away from a corresponding frame member towards an exterior of the building structure for receiving a corresponding wall panel, each chair member being sufficiently rigid for supporting the corresponding wall panel in a cantilevered configuration relative to the corresponding frame member, each supporting chair member having a proximal side end disposed towards the corresponding frame member, a distal side end disposed away from the corresponding frame member and an appendage connector located at the distal side end; and an exterior appendage member having a distal chair connector for engaging the appendage connector of at least one supporting chair member to attach the appendage member to the at least one supporting chair member such that the exterior appendage member extends away from the at least one supporting chair member and towards the exterior of the building structure.

In one embodiment, the system further comprises a resilient member extending between the appendage connector of the chair member and the distal chair connector of the exterior appendage member when the appendage connector engages the distal chair connector to urge the appendage connector into engagement with the distal chair connector.

In one embodiment, the resilient member includes a leaf spring.

In one embodiment, the appendage connector of the chair member includes a hook portion and the distal chair connector of the exterior appendage includes an inwardly extending recess sidewall defining a hook recess for receiving the hook portion, the resilient member being secured to and extending away from the hook portion to abut and push against the recess sidewall of the distal chair connector when the hook portion is received in the hook recess.

In one embodiment, the appendage member is selected from a group consisting of: a cap member, a sunshade assembly, a fin and an ornament.

In one embodiment, the supporting chair member is distinct from the corresponding frame member and includes a frame connector located at its proximal side end, and further wherein each frame member including a proximal chair connector disposed towards the supporting chair member for engaging the frame connector to attach the supporting chair member to the corresponding frame member.

In one embodiment, the corresponding frame member includes an outer wall facing laterally towards the exterior of the building structure, the proximal chair connector including a receiving groove defined in the outer wall of the corresponding frame member and extending longitudinally along the corresponding frame member.

In one embodiment, each exterior appendage member is removably connected to at least two supporting chair members.

In one embodiment, the at least two chair members are spaced apart from each other longitudinally along the corresponding frame member.

In one embodiment, each supporting chair member includes a proximal chair section disposed towards the corresponding frame member and a distal chair section disposed away from the corresponding frame member, the proximal chair section including a first intermediate connector and the distal chair section including a second intermediate connector for engaging the first intermediate connector to attach the proximal chair section to the distal chair section.

In one embodiment, the first and second intermediate connectors, when engaged together, form a channel therebetween, the channel defining a thermal break between the proximal and distal chair sections.

In one embodiment, the wall panel is secured to the corresponding frame member using an adhesive material provided therebetween.

In one embodiment, the adhesive material includes a structural silicone sealant.

According to one aspect, there is also provided a panel support assembly for a curtain wall system, the curtain wall system including a frame structure having a plurality of spaced-apart frame members, and a plurality of wall panels secured to the frame structure to define an outer wall for a building structure, the assembly comprising: a plurality of supporting chair members connectable to a corresponding frame member of the frame structure so as to extend laterally away from the corresponding frame member towards an exterior of the building structure, each chair member being sufficiently rigid for receiving and supporting a wall panel in a cantilevered configuration relative to the corresponding frame member, each supporting chair member having a proximal side end disposed towards the corresponding frame member, a distal side end disposed away from the corresponding frame member and an appendage connector located at the distal side end; and an exterior appendage member having a distal chair connector for engaging the appendage connector of at least one of the supporting chair members to attach the appendage member to the corresponding supporting chair member such that the exterior appendage member extends away from the supporting chair member and towards the exterior of the building structure.

In one embodiment, the assembly further comprises a resilient member extending between the appendage connector of the chair member and the distal chair connector of the exterior appendage member when the appendage connector engages the distal chair connector to urge the appendage connector into engagement with the distal chair connector.

In one embodiment, the resilient member includes a leaf spring.

In one embodiment, the appendage connector of the chair member includes a hook portion and the distal chair connector of the exterior appendage includes an inwardly extending recess sidewall defining a hook recess for receiving the hook portion, the resilient member being secured to and extending away from the hook portion to abut and push against the recess sidewall of the distal chair connector when the hook portion is received in the hook recess.

In one embodiment, the appendage member is selected from a group consisting of: a cap member, a sunshade assembly, a fin and an ornament.

In one embodiment, each supporting chair member includes a proximal chair section disposed towards the corresponding frame member and a distal chair section disposed away from the corresponding frame member, the proximal chair section including a first intermediate connector and the distal chair section including a second intermediate connector for engaging the first intermediate connector to attach the proximal chair section to the distal chair section.

In one embodiment, the first and second intermediate connectors, when engaged together, form a channel therebetween, the channel defining a thermal break between the proximal and distal chair sections.

In one embodiment, the wall panel is secured to the corresponding frame member using an adhesive material provided therebetween.

In one embodiment, the adhesive material includes a structural silicone sealant.

According to another aspect, there is also provided a curtain wall system for a building structure, the system comprising: a frame structure including a plurality of spaced-apart frame members, each frame member including a proximal chair connector disposed towards an exterior of the building structure; a plurality of wall panels secured to the frame structure to define an outer wall for the building structure; a plurality of supporting chair members extending laterally away from a corresponding frame member towards an exterior of the building structure for receiving a corresponding wall panel, each chair member being sufficiently rigid for supporting the corresponding wall panel in a cantilevered configuration relative to the corresponding frame member, each supporting chair member having a proximal side end disposed towards the corresponding frame member, a distal side end disposed away from the corresponding frame member, the supporting chair member further including: a frame connector located at its proximal side end for engaging the proximal chair connector of the corresponding frame member to attach the supporting chair member to the corresponding frame member; an appendage connector located at the distal side end; an exterior appendage member having a distal chair connector for engaging the appendage connector of at least one of the supporting chair members to attach the appendage member to the corresponding supporting chair member such that the exterior appendage member extends away from the supporting chair member and towards the exterior of the building structure; and a resilient member disposed between the appendage connector and the distal chair connector to urge the appendage connector into engagement with the chair connector.

In one embodiment, the resilient member includes a leaf spring.

In one embodiment, the appendage connector includes a hook portion and the distal chair connector includes an inwardly extending recess sidewall defining a hook recess for receiving the hook portion, the resilient member being secured to and extending away from the hook portion to abut and push against the recess sidewall of the distal chair connector when the hook portion is received in the hook recess.

According to another aspect, there is also provided a curtain wall system for a building structure, the system comprising: a frame structure including a plurality of spaced-apart frame members; and a plurality of supporting chair members extending laterally away from a corresponding frame member towards an exterior of the building structure for receiving a corresponding wall panel, each supporting chair member being sufficiently rigid for supporting the corresponding wall panel in a cantilevered configuration relative to the corresponding frame member, each supporting chair member having a proximal side end disposed towards the corresponding frame member, a distal side end disposed away from the corresponding frame member and an appendage connector located at the distal side end, the appendage connector being configured for engaging a distal chair connector of an exterior appendage member to attach the appendage member to the supporting chair member such that the exterior appendage member extends away from the at least one supporting chair member and towards the exterior of the building structure.

DETAILED DESCRIPTION

Figure 1:
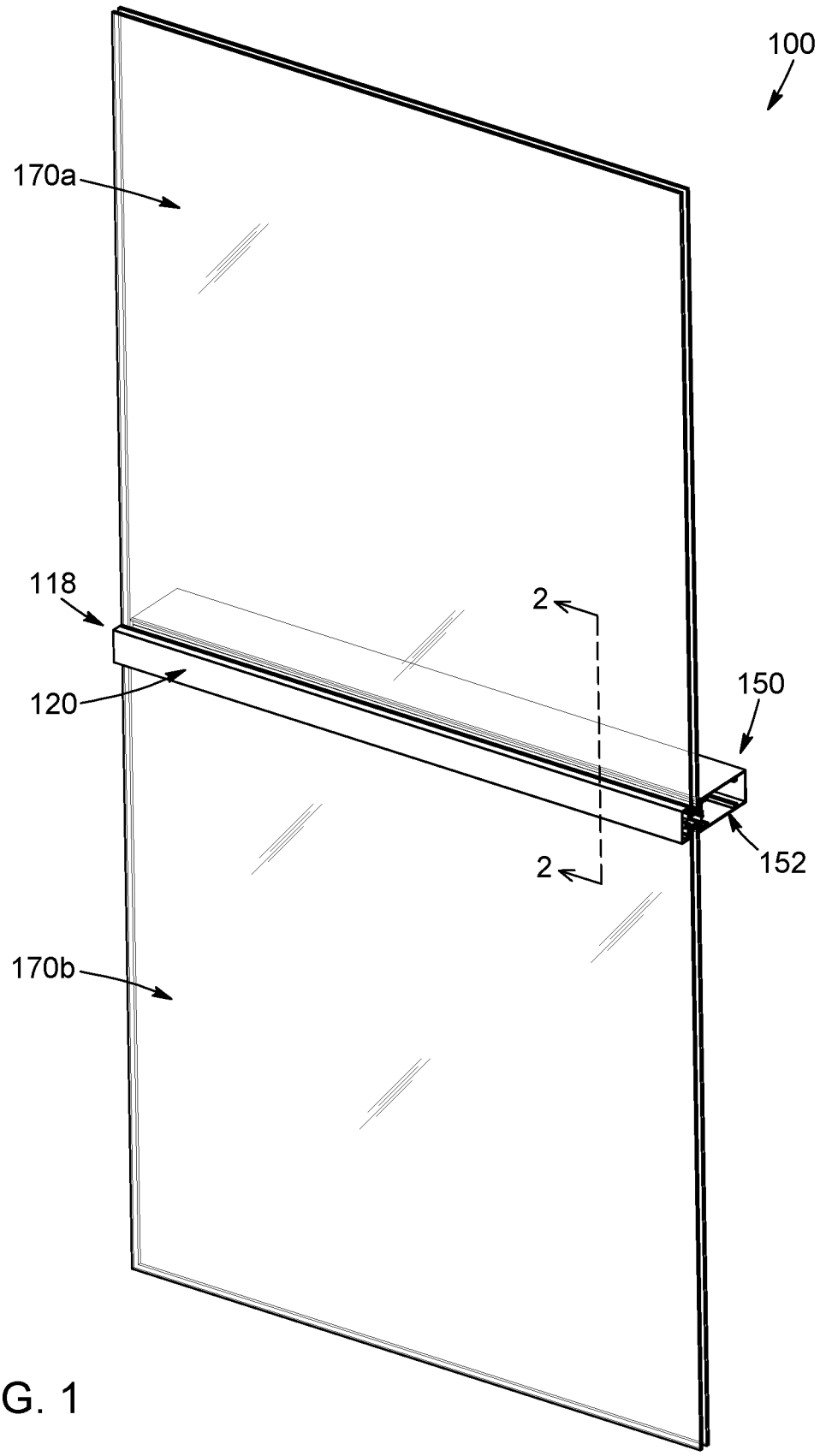
FIG. 1 is a perspective view of a portion of a curtain wall system, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

Referring to FIGS. 1 to 4B, there is provided a curtain wall system 100 for a building structure, in accordance with one embodiment.

In the illustrated embodiment, the curtain wall system 100 includes a frame structure 150 and a plurality of wall panels 170*a*, 170*b* secured to the frame structure 150. The frame structure 150 includes a plurality of elongated frame members which are secured to each other and which are generally disposed in a common frame plane. The frame structure 150 is further configured to be secured to an outer perimeter of a load-carrying structural element of the building structure, e.g. the outer edge of the building structure's floor slabs, such that the frame plane extends generally vertically along the outer perimeter of the building structure.

Specifically, the elongated frame members include a first plurality of spaced-apart frame members or vertical frame members, not shown, and a second plurality of spaced-apart frame members or horizontal frame members 152 extending generally perpendicularly to the vertical frame members and secured to the vertical frame members. The frame structure 150 is configured such that when the frame structure 150 is secured to the building structure, the horizontal frame members 152 extend generally horizontally and the vertical frame members extend generally vertically.

Figure 2:
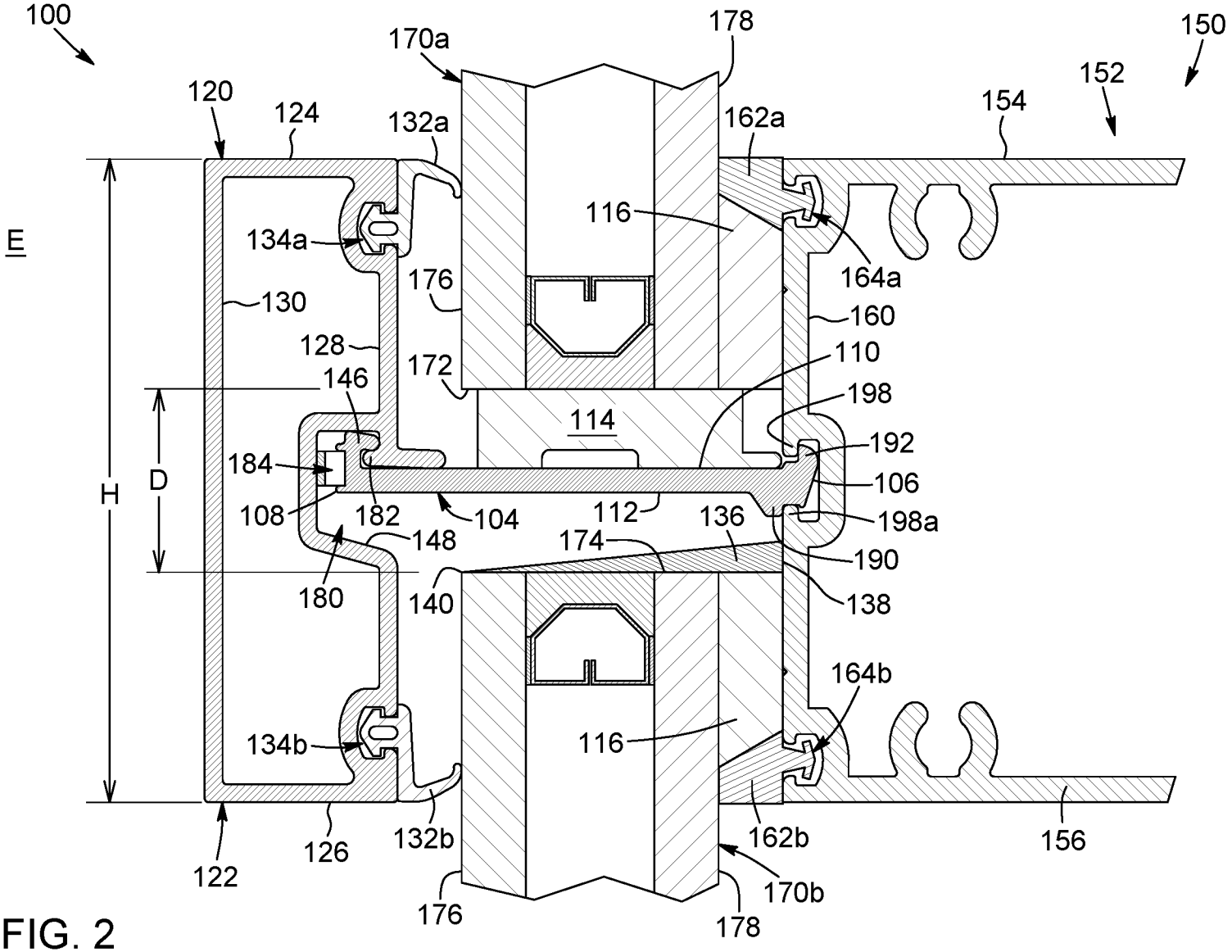
FIG. 2 is a cross-section view, taken along cross-section line 2-2, of the curtain wall system illustrated in FIG. 1.
Figure 3:
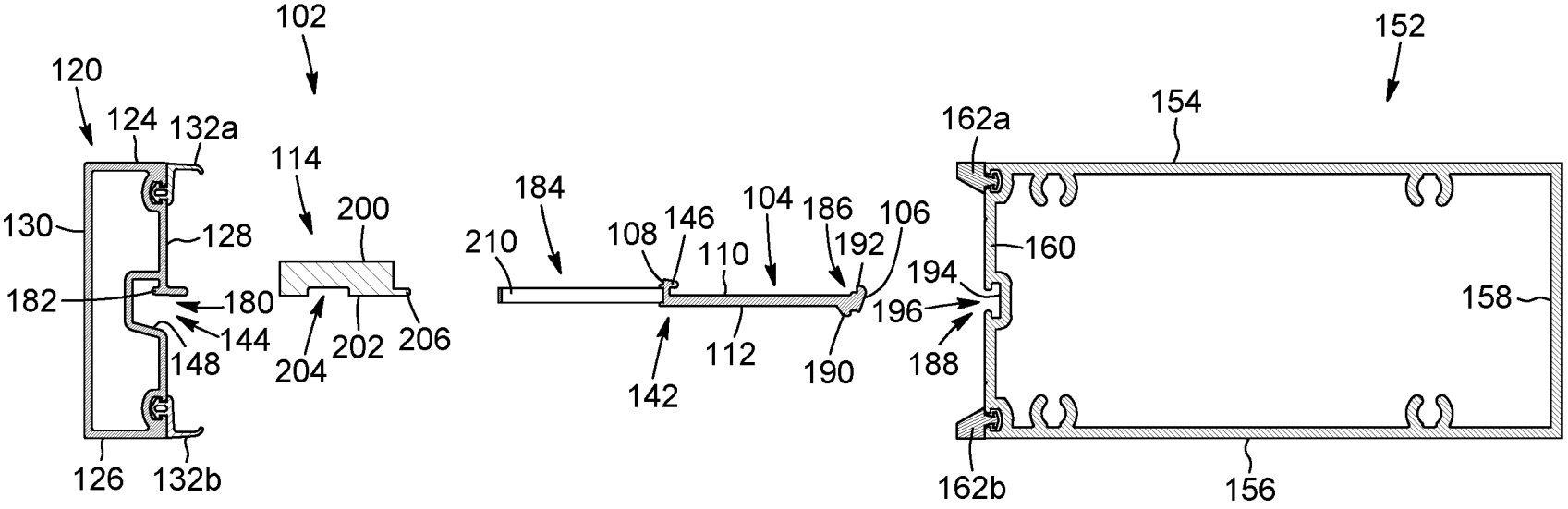
FIG. 3 is an exploded cross-section view of the curtain wall system illustrated in FIG. 1, with the glass panels removed to better appreciate details of the panel support assembly.

Still in the illustrated embodiment, the wall panels 170*a*, 170*b* are connected to the horizontal frame members 152 using a plurality of panel support assemblies 102, best shown in FIGS. 2 and 3, and extend generally vertically and across gaps defined between the vertical and horizontal frame members 152, thereby defining an outer wall to close off the side of the building structure when the frame structure 150 is connected to the building structure.

In one embodiment, the wall panels 170 are made of glass but, alternatively, the wall panels 170 could be made of any other material which a skilled person would consider to be suitable.

In the illustrated embodiment, the horizontal frame members 152 are hollow and have a generally rectangular cross-section. More specifically, each horizontal frame member 152 includes planar top and bottom walls 154, 156 extending parallel to each other and inner and outer side walls 158, 160 extending parallel to each other and perpendicularly to the top and bottom walls 154, 156. When the frame structure 150 is assembled to form the outer wall of the building structure, the top and bottom walls 154, 156 extend generally horizontally and the inner and outer side walls 158, 160 extend generally vertically, with the outer side wall 160 being disposed towards an exterior E of the building structure and the inner side wall 158 being disposed away from the exterior E of the building structure.

The panel support assemblies 102 extend laterally from the horizontal frame members 150 towards the exterior E of the building. In the illustrated embodiment, each panel support assembly 102 includes a plurality of supporting chair members 104 which extend away from the horizontal frame members 150 to provide a cantilevered support for an upper wall panel 170*a*. Each supporting chair member 104 includes a proximal side end 106 disposed towards the horizontal frame member 152 and a distal side end 108 disposed away from the horizontal frame member 152. In the illustrated embodiment, each supporting chair member 104 is generally flat and further includes planar top and bottom faces 110, 112 which extend generally parallel to each other.

The top face 110 of the supporting chair member 104 is adapted to receive a setting block 114 which is disposed between the supporting chair member 104 and a lower end 172 of the upper wall panel 170*a*. More specifically, the setting block 114 is made of a deformable material such as an elastomeric material or the like to allow the upper wall panel 170*a* to sit on and be properly supported by the supporting chair member 104 while providing a relatively non-rigid connection between the supporting chair member 104 and the upper wall panel 170*a*. This allows some movement or deformation of the upper wall panel 170*a*, such as deformations due to changes in temperature, for example, which may otherwise create stress within the wall panels 170 and damage the wall panels 170.

In the illustrated embodiment, the setting block 114 has a generally rectangular cross-section and includes a top face 200 for receiving the lower end 172 of the upper wall panel

170*a* and a bottom face 202 adapted to be placed in contact with the top face 110 of the supporting chair member 104. Still in the illustrated embodiment, the setting block 114 further includes a groove 204 which extends into the bottom face 202 towards the top face 200.

The setting block 114 further includes a stop portion 206 which is located near the bottom face 202 of the setting block 114 and which projects towards the horizontal frame member 152. In the illustrated embodiment, the stop portion 206 is sized and shaped to abut the outer side wall 160 of the horizontal frame member 152 when the setting block 114 is generally in horizontal alignment with the lower end 172 of the upper wall panel 170*a*. It will be appreciated that this feature facilitates installation of the setting block 114 and the upper wall panel 170*a* by ensuring that the setting block 114 can be easily positioned in horizontal alignment with the upper wall panel 170*a*. Alternatively, the setting block 114 may not include a stop projection 206.

Still referring to FIGS. 1 to 4B, each panel support assembly 102 further includes an exterior appendage member 118 which extends away from the supporting chair member 104 and towards the exterior E of the building structure. In the illustrated embodiment, the exterior appendage member 118 includes a cap member 120 which is elongated, and which extends substantially parallel to the horizontal frame member 152. The cap member 120 is spaced laterally from the horizontal frame member 152, towards the exterior E of the building to allow the lower end 172 of the upper wall panel 170*a* to be received between the cap member 120 and the horizontal frame member 152.

In the illustrated embodiment, the cap member 120 is connected to the distal side end 108 of the supporting chair member 104 and is therefore directly attached to the supporting chair member 104. This configuration obviates the need for additional connection elements to attach the cap member 120 to the frame structure 150, as will be further explained below.

In the illustrated embodiment, the wall panel 170*a* is secured to the horizontal frame member 152 using adhesive material, as will be explained further below. The cap member 120 therefore does not have a structural role in securing the wall panel 170*a* to the frame structure 150 and is provided instead as a decorative feature to provide an aesthetically pleasing appearance to the exterior of the building structure.

In the illustrated embodiment, the cap member 120 includes a hollow extruded body 122 which has planar top and bottom walls 124, 126 which extend parallel to each other and inner and outer side walls 128, 130 which extend generally parallel to each other and perpendicularly to the top and bottom walls 124, 126. When the cap member 120 is mounted to the supporting chair member 104, the outer side wall 130 of the cap member 120 faces towards the exterior E of the building structure and the inner side wall 128 of the cap member faces towards the supporting chair member 104.

As shown in FIG. 2, the inner and outer side walls 128, 130 are further generally vertical and parallel to the inner and outer side walls 158, 160 of the horizontal frame member 152, and the top and bottom walls 124, 126 of the cap member 120 extend generally horizontally. Moreover, the cap member 120 has generally the same height as the horizontal frame member 152, such that the top wall 124 of the cap member 120 is generally vertically aligned with the top wall 154 of the horizontal frame member 152 and the bottom wall 126 of the cap member 120 is generally aligned with the bottom wall 156 of the horizontal frame member 152.

Alternatively, the cap member 120 may have a different height from the horizontal frame member 152.

Still in the illustrated embodiment, the panel support assembly 102 is further adapted to receive an upper end 174 of a lower wall panel between the cap member 120 and the horizontal frame member 152, below the supporting chair member 104. Specifically, the cap member 120 overlaps the upper and lower wall panels 170*a*, 170*b* to thereby seal the gap between the lower end 172 of the upper wall panel 170*a* and the upper end 174 of the lower wall panel 170*b* and to cover the panel support assembly 102 to hide it from view from the exterior E of the building structure. Therefore, as shown in FIG. 2, the lower end 172 of the upper wall panel 170*a* and the upper end 174 of the lower wall panel 170*b* are spaced from each other vertically by a certain distance D, while the cap member 120 has a height H which is greater than the distance D.

In the illustrated embodiment, the cap member 120 further includes upper and lower sealing members 132*a*, 132*b* which are received into corresponding receiving recesses 134*a*, 134*b* defined in the inner wall 128 of the cap member 120 and which extend generally longitudinally along the cap member 120. The sealing members 132*a*, 132*b* extend from the inner wall 128 of the cap member 120 laterally towards the horizontal frame members 152 to abut the upper and lower wall panels 170*a*, 170*b* received between the cap member 120 and the horizontal frame members 152.

More specifically, when the upper and lower wall panels 170*a*, 170*b* are received between the cap member 120 and the horizontal frame member 152, each one of the upper and lower wall panels 170*a*, 170*b* defines an exterior face 176 facing towards the exterior E of the building and an interior face 178 facing away from the exterior E of the building. The upper sealing member 132*a* is located near the top wall 124 of the cap member 120 and abuts the exterior face 176 of the upper wall panel 170*a*, and the lower sealing member 132*b* is located near the bottom wall 126 of the cap member 120 and abuts the exterior face 176 of the lower wall panel 170*b*.

Similarly, the horizontal frame member 152 also includes upper and lower sealing members 162*a*, 162*b* which are received into corresponding receiving recesses 164*a*, 164*b* defined in the outer wall 160 of the horizontal frame member 152 and which extend generally longitudinally along the horizontal frame member 152. The upper and lower sealing members 162*a*, 162*b* extend from the outer wall 160 of the horizontal frame member 150 laterally towards the cap member 120 to abut the upper and lower wall panels 170*a*, 170*b* received between the cap member 120 and the horizontal frame member 152.

Specifically, the upper sealing member 162*a* is located near the top wall 154 of the horizontal frame member 152 and abuts the interior face 178 of the upper wall panel 170*a*, and the lower sealing member 162*b* is located near the bottom wall 156 of the horizontal frame member 152 and abuts the interior face 178 of the lower wall panel 170*b*.

In the illustrated embodiment, the supporting chair member 104 has a length L which is selected such that the upper and lower sealing members 132*a*, 132*b*, 162*a*, 162*b* are slightly deformed and/or compressed when the cap member 120 is connected to the supporting chair member 104 to thereby seal off the interface between the cap member 120 and the upper and lower wall panels 170*a*, 170*b* and between the upper and lower wall panels 170*a*, 170*b* and the horizontal frame member 152.

In one embodiment, the upper and lower sealing members 132*a*, 132*b* of the cap member 120 are manufactured from a first elastomeric material such as EPDM rubber, while the upper and lower sealing members 162*a*, 162*b* of the horizontal frame members 152 are manufactured from a second elastomeric material such as silicone rubber. Alternatively, the upper and lower sealing members 132*a*, 132*b* of the cap member 120 and the upper and lower sealing members 162*a*, 162*b* of the horizontal frame member 152 may be made of the same elastomeric material, or may be made of any other material which a skilled person would consider to be suitable.

In the illustrated embodiment, the upper wall panel 170*a* is further secured to the horizontal frame member 152 using an adhesive material 116 which is provided between the outer side wall 160 of the horizontal frame member 152 and the interior face 178 of the upper wall panel 170*a*. Similarly, the adhesive material 116 may further be provided between the outer side wall 160 of the horizontal frame member 152 and the interior face 178 of the lower wall panel 170*b* to thereby further secure the lower wall panel 170*b* to the horizontal frame member 152.

In one embodiment, the adhesive material 116 may include a structural silicone sealant. Alternatively, the adhesive material 116 may include any other type of adhesive material that a skilled person would consider to be suitable.

In the illustrated embodiment, the horizontal frame member 152 further includes a wedge-shaped cover member 136 which extends generally horizontally and away from the outer side wall 160 of the horizontal frame member 152 and towards the cap member 120. The cover member 136 is sized and shaped to extend over and seal the upper end 174 of the lower wall panel 170*b*. The cover member 136 includes a first side end 138 adjacent the outer side wall 160 of the horizontal frame member 152 and a second side end 140 located away from the outer side wall 160 of the horizontal frame member 152. Moreover, the thickness of the cover member 136 tapers down from the first side end 138 to the second side end 140 to guide water received on the cover member 136 towards the exterior E of the building structure.

In the illustrated embodiment, the cap member 120 is removably connected to the supporting chair member 104. Specifically, the distal side end 108 of the supporting chair member 104 includes an appendage connector 142 and the cap member 120 includes a distal chair connector 144 which is configured to connect with the appendage connector 142.

Still in the illustrated embodiment, the appendage connector 142 includes a hook portion 146 which extends first generally upwardly from the distal side end 108 of the supporting chair member 104 and then hooks back generally horizontally towards the proximal side end 106 of the supporting chair member 104.

The distal chair connector 144 of the exterior appendage member 118 includes a recess sidewall 148 which extends inwardly into the cap member 120 from the inner side wall 128 towards the outer side wall 130 of the cap member 120 to define a hook recess 180. In the illustrated embodiment, the hook recess 180 further extends longitudinally along the cap member 120.

The distal chair connector 144 further includes a catch member 182 which extends into the hook recess 180 towards the outer side wall 130 of the cap member 120. The catch member 182 is sized and shaped to engage the hook portion 146 of the supporting chair member 104 to thereby connect the cap member 120 to the supporting chair member 104.

In the illustrated embodiment, the appendage connector 142 further includes a resilient member 184 disposed between the appendage connector 142 and the distal chair connector 144 to urge the appendage connector 142 into engagement with the distal chair connector 144. Specifically, the resilient member 184 includes a leaf spring 210 which extends from the hook portion 146 of the appendage connector 142 away from the proximal side end 106 of the supporting chair member 104. When the hook portion 146 is received in the hook recess 180 such that the catch member 182 engages the hook portion 146, the leaf spring 210 is compressed and pushes against the recess sidewall 148 of the hook recess 180, thereby maintaining the catch member 182 into the hook portion 146 and preventing the hook portion 146 from being removed from the hook recess 180.

It will be appreciated that in addition to the leaf spring 210, the upper and lower sealing members 132*a*, 132*b* could further be at least slightly resilient and urge the cap member 120 away from the upper and lower wall panels 170*a*, 170*b*.

To connect the cap member 120 with the supporting chair member 104, the hook portion 146 may simply be vertically aligned with the hook recess 180, below the catch portion 182, and the cap member 120 may be moved laterally towards the horizontal frame member 152 until the hook portion 146 moves past the catch member 182. This lateral movement of the cap member 120 will compress the leaf spring 210 between the recess sidewall 148 and the hook portion 146 of the supporting chair member 104, and will also slightly compress and/or deform the upper and lower sealing members 132*a*, 132*b* between the cap member 120 and the upper and lower wall panels 170*a*, 170*b*. The cap member 120 may then be moved vertically downwardly along the upper and lower wall panels 170*a*, 170*b* until the hook portion 146 is past the catch member 182, and the cap member 120 may then be moved away from the upper and lower wall panels 170*a*, 170*b* or simply released such that the leaf spring 210 may urge the catch member 182 into the hook portion 146. When the catch member 182 is fully engaged in the hook portion 146, the upper and lower sealing members 132*a*, 132*b* of the cap member 120 and of the horizontal frame member 152 may still be compressed and/or deformed to thereby further ensure sealing between the cap 120 and the upper and lower wall panels 170*a*, 170*b* and between the upper and lower wall panels 170*a*, 170*b* and the horizontal frame member 152.

It will be understood that the appendage connector 142 and the distal chair connector 144 do not require any additional mounting fasteners, which facilitates the installation of the cap member 120 to the supporting chair member 104, and therefore of the wall panels 170*a*, 170*b* to the frame structure 150. Moreover, the appendage connector 142 and the distal chair connector 144 described above may be sturdier, provide more stability and be more forgiving in accommodating manufacturing tolerances than conventional systems.

It will also be appreciated that in this configuration, the supporting chair member 104 both supports the upper wall panel 170*a* and connects with the cap member 120, and therefore eliminates the need for multiple distinct parts, such as a supporting chair and a distinct cap clip, to accomplish these functions. This reduces the complexity of manufacturing and of installing the panel support assembly 102 and may also reduce the cost of manufacturing the panel support assembly 102.

In the illustrated embodiment, each supporting chair member 104 is further distinct from the horizontal frame member 152 and is attached to the horizontal frame member 152 using connectors. More specifically, each supporting chair member 104 includes a frame connector 186 at its proximal side end 106 and the horizontal frame member 152 includes a proximal chair connector 188 which is configured for connecting with the frame connector 186.

In the illustrated embodiment, the frame connector 186 includes a lower protruding portion 190 which extends away from the bottom face 112 of the supporting chair member 104 near the proximal side end 106 and an upper protruding portion 192 which extends upwardly from the top face 110 of the supporting chair member 104 at the proximal side end 106. Specifically, the lower protruding portion 190 is generally located slightly more towards the distal side end 108 than the upper protruding portion 192.

Figure 4A:
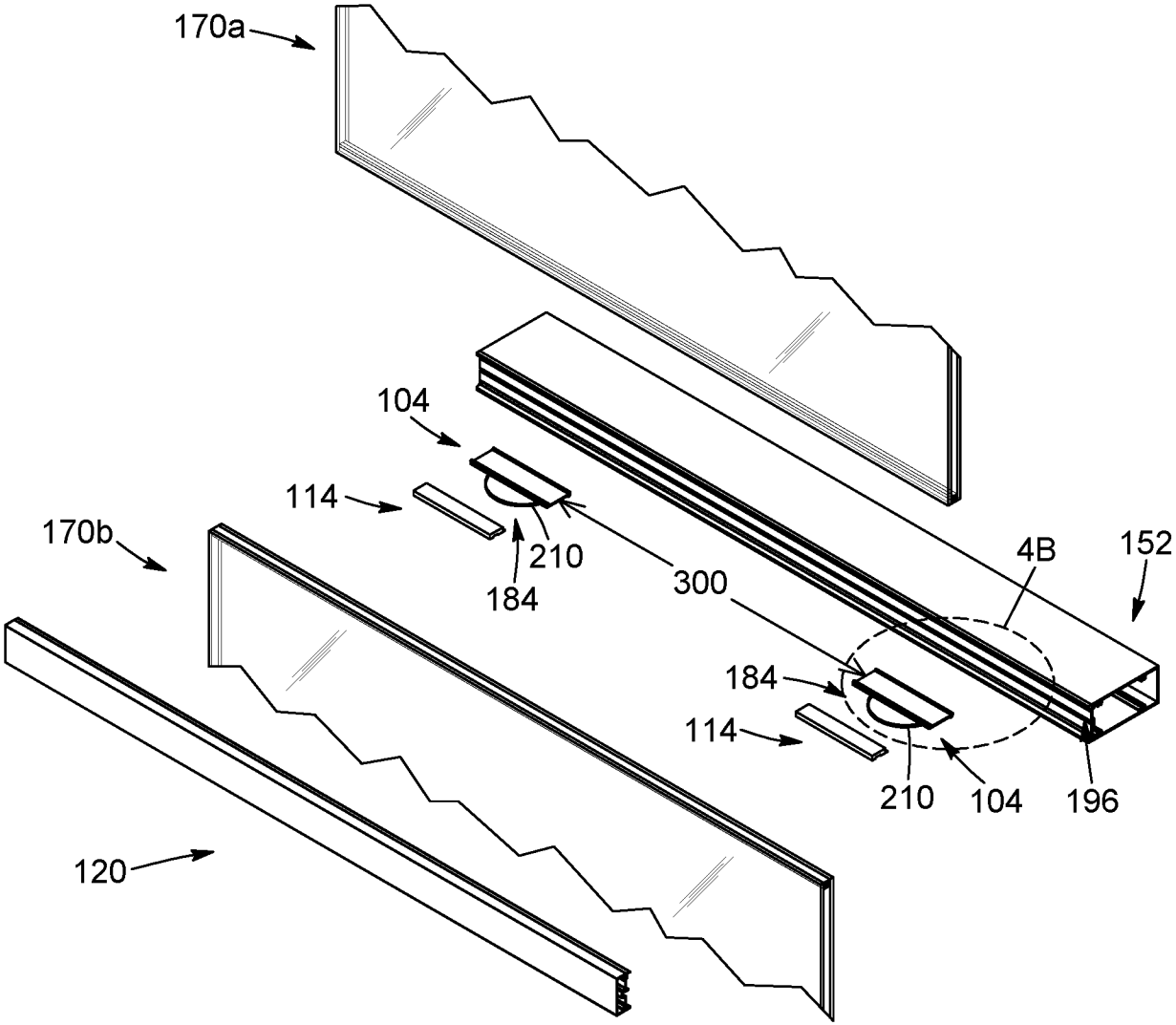
FIG. 4A is a perspective exploded view of the curtain wall system illustrated in FIG. 1.
Figure 4B:
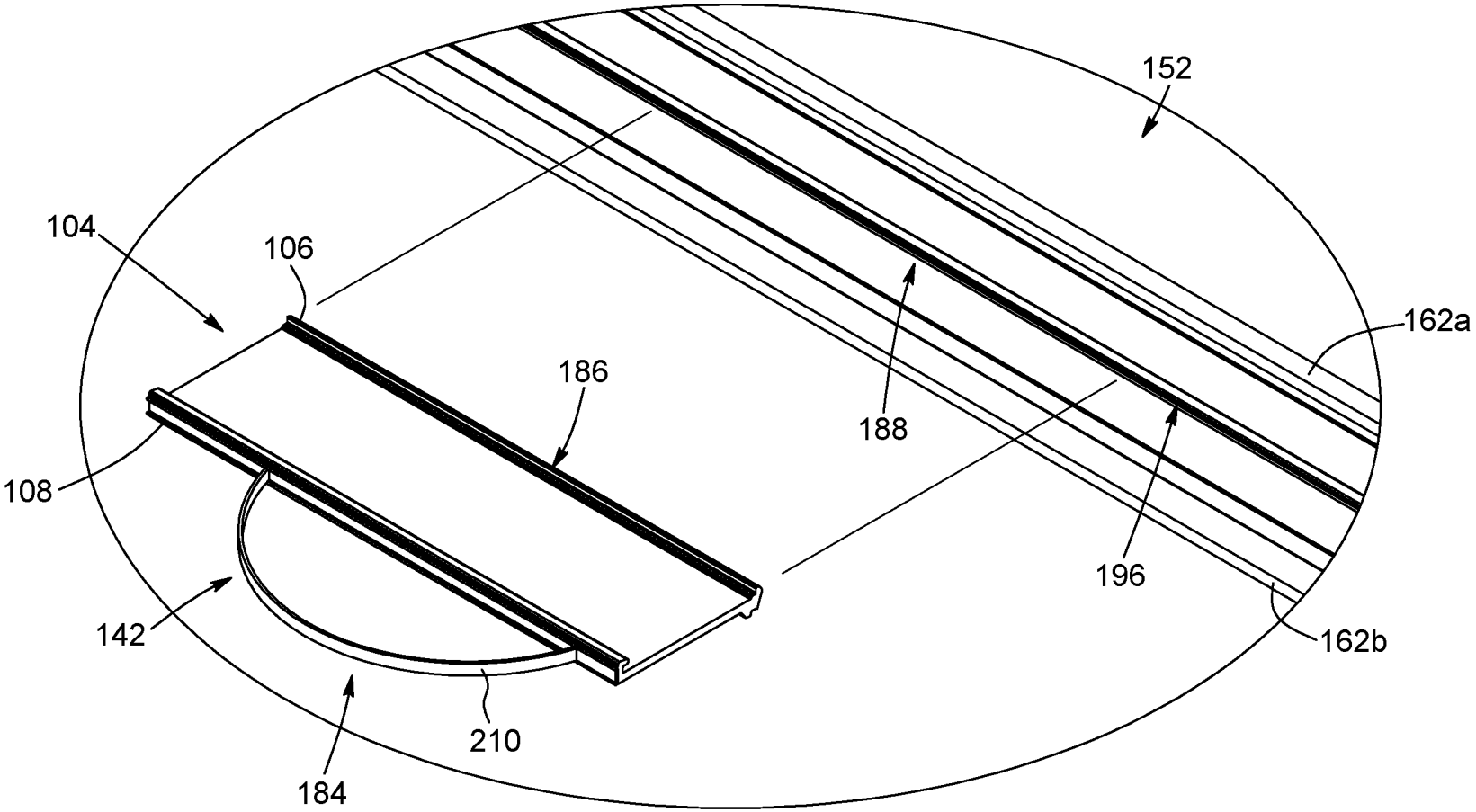
FIG. 4B is an enlarged view, taken from area 4B, of a portion of the curtain wall system illustrated in FIG. 4A.

Still in the illustrated embodiment, the proximal chair connector 188 includes a groove sidewall 194 extending into the outer side wall of the horizontal frame member 152 towards the inner side wall to define a receiving groove 196 for receiving the frame connector 186. As best shown in FIGS. 4A and 4B, the receiving groove 196 extends generally longitudinally along the horizontal frame member 152. The receiving groove 196 further has a generally T-shaped cross-section. More specifically, the groove sidewall 194 includes an upper catch member 198*a* which extends downwardly and a lower catch member 198*b* which extends upwardly. When the frame connector 186 is inserted into the receiving groove 196, the upper protruding portion 192 is inside the receiving groove 196 and abuts the upper catch member 198*a*, while the lower protruding portion 190 is located outside the receiving groove 196 and abuts the outer side wall 160 of the horizontal frame member 152.

It will be appreciated that in this configuration, the supporting chair member 104 is prevented from pivoting under the weight of the upper wall panel 170*a* and may thereby provide a relatively sturdy cantilevered support for the upper wall panel 170*a*.

In one embodiment, the supporting chair member 104 may be attached to the horizontal frame member 152 by angling the supporting chair member 104 upwardly such that the distal side end 108 is higher than the proximal side end 106, and then moving the supporting chair member 104 laterally towards the horizontal frame member 152 until the proximal side end 106 is inserted into the receiving groove 196. The supporting chair member 104 could then be pivoted downwardly by lowering the distal side end 108 until the upper protruding portion 192 abuts the upper catch member 198*a* and the lower protruding portion 190 abuts the outer side wall 160 of the horizontal frame member 152.

In one embodiment, the panel supporting assembly 102 may not require any additional fastener to attach the supporting chair member 104 to the horizontal frame member 152. More specifically, the supporting chair member 104 may simply be maintained in connection with the horizontal frame member 152 by the weight of the upper wall panel 170*a* urging the upper protruding portion 192 against the upper catch member 198*a* and the lower protruding portion 190 against the outer side wall 160 of the horizontal frame member 152. Alternatively, the supporting chair member 104 could further be secured to the horizontal frame member 152 using fasteners, adhesive, welding or any other securing technique which a skilled person may consider to be appropriate.

In the illustrated embodiment, each cap member 120 is removably connected to more than one supporting chair member 104. Specifically, as shown in FIG. 4A, the plurality of supporting chair members 104 are spaced apart from each other longitudinally along the horizontal frame member 152 and thereby define gaps 300 between adjacent chair members 104. Still in the illustrated embodiment, the cap member 120 is elongated and spans across the gap 300 between two adjacent supporting chair members 104 to connect with at least two supporting chair members 104.

In this configuration, the cap member 120 is not in contact with the supporting chair members 104 along its entire length. It will be appreciated that thermal exchanges between the cap member 120 and the supporting chair members 104 are thereby reduced.

It will be appreciated that in this embodiment, each setting block 114 generally has the same length as the corresponding supporting chair member 104. Therefore, the setting blocks 114 are also non-continuous and do not contact the lower end 172 of the upper wall panel 170*a* along its entire length, thereby also reducing thermal exchanges between the upper wall panel 170*a* and the setting blocks 114.

To further reduce thermal exchanges between the exterior and the interior of the building structure, the supporting chair member 104 could include a thermal break made of an insulating material and disposed generally between the appendage connector and the distal chair connector 144. This configuration would contribute to reducing thermal exchanges between the cap member 120 and the supporting chair member 104.

In another embodiment, a similar thermal break could be disposed generally between the frame connector 186 and the proximal chair connector 188 to thereby reduce thermal exchanges between the supporting chair member 104 and the horizontal frame member 152.

In yet another embodiment, the supporting chair member 104 could even be made of two or more distinct sections, each section being connected to an adjacent section by a thermal break portion to substantially prevent thermal exchanges between sections along the supporting chair member 104.

Figure 5:
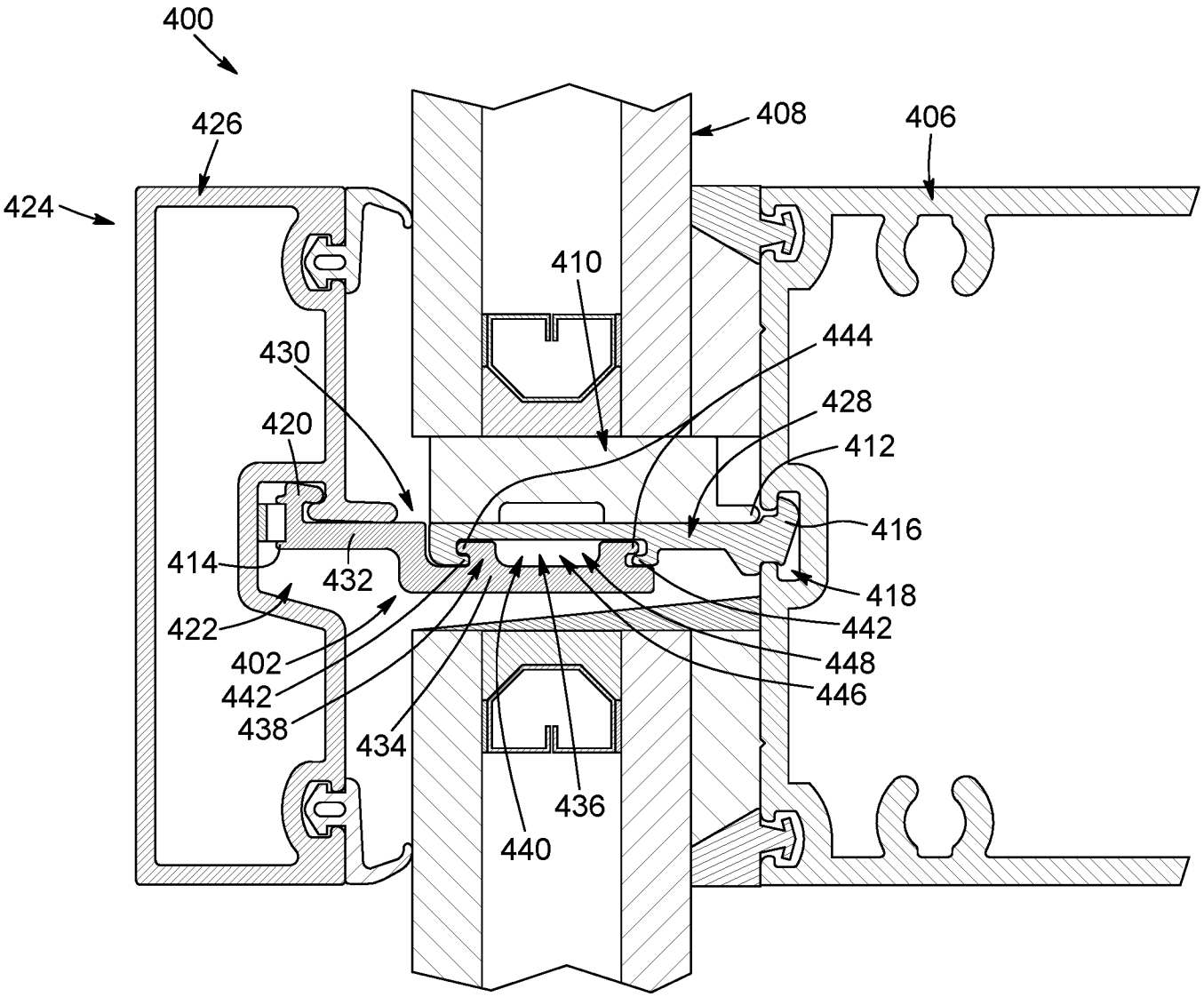
FIG. 5 is a cross-section view of a curtain wall system, in accordance with another embodiment.

Turning now to FIG. 5, there is shown a curtain wall system 400, in accordance with another embodiment. Similarly to the curtain wall system 100 illustrated in FIGS. 1 to 4B, the curtain wall system 400 includes a plurality of supporting chair members 402 extending away from a horizontal frame member 406 of a building structure and towards the exterior of the building structure. Each supporting chair member 402 is adapted to receive a wall panel 408 which is received on a setting block 410 disposed between the wall panel 408 and the supporting chair member 402.

As shown in FIG. 5, the supporting chair member 402 has a proximal side end 412 located near the horizontal frame member 406 and a distal side end 414 located away from the horizontal frame member 406.

Similarly to the supporting chair member 104 illustrated in FIGS. 1 to 4B, the supporting chair member 402 further includes a frame connector 416 located at the proximal side end 412 for engaging a proximal chair connector 418 located on the horizontal frame member 406 to attach the supporting chair member 402 to the horizontal frame member 406. The supporting chair member 402 also includes an appendage connector 420 located at the distal side end 414 for engaging a corresponding distal chair connector 422 of an exterior appendage member 424 such as a cap member 426 to thereby attach the cap member 426 to the supporting chair member 402.

In the embodiment illustrated in FIG. 5, the supporting chair member 104 is not made of a single, unitary body, but instead includes two distinct sections: a proximal chair section 428 and a distal chair section 430 which is distinct from the proximal chair section 428. More specifically, the proximal chair section 428 is disposed towards the horizontal frame member 406 and the distal chair section 430 is disposed away from the horizontal frame member 406.

Still in the embodiment illustrated in FIG. 5, the proximal chair section 428 and the distal chair section 430 overlap each other. Specifically, the distal chair section 430 is generally Z-shaped and includes an upper planar portion 432 and a lower planar portion 434 which is generally parallel to the upper planar portion 432 but which is offset relative to the upper planar portion 432 rather than being coplanar with the upper planar portion 432. The proximal chair section 428 includes a first intermediate connector 436 which faces downwardly and the lower planar portion 434 includes a second intermediate connector 438 which faces upwardly to engage the first intermediate connector 436.

When the first and second intermediate connectors 436, 438 are engaged together, the lower planar portion 434 is located below the proximal chair section 428, while the upper planar portion 432 is generally coplanar to the proximal chair section 428 and extends away from the proximal chair section 428 towards the exterior of the building structure.

In the embodiment illustrated in FIG. 5, the first intermediate connector 436 includes an outer recess 440 defined between spaced-apart inwardly facing hook members 442. The second intermediate connector 438 is sized and shaped to be received in the outer recess 440 and includes a pair of spaced-apart outwardly facing hook members 444 sized and shaped to engage the inwardly facing hook members 442 of the first intermediate connector 436. The second intermediate connector 438 further includes an upwardly facing inner recess 446 defined between the outwardly facing hook members 444.

As shown in FIG. 5, the first and second intermediate connectors 436, 438 are engaged together, the inner recess 446 form a channel 448 between the first and second intermediate connectors 436, 438, such that the first and second intermediate connectors 436, 438 are not in contact with each other along their entire width. In the illustrated embodiment, the channel 448 contains air and thereby defines a thermal break between the proximal and distal chair sections 428, 430 to thermally insulate the proximal chair section 428 from the distal chair section 430 and from the exterior of the building structure. Alternatively, instead of air, the channel 448 may contain any other insulating material which a skilled person would consider to be appropriate.

It will be appreciated that the above embodiments are merely provided as examples, and that various alternative configurations may be considered. For example, instead of including two distinct sections, the supporting chair member may instead include three or more distinct sections which are interconnected together to define the supporting chair member.

In another embodiment, instead of a cap member, the exterior appendage member 118 could instead include a sunshade assembly, a fin, an ornament or any other type of exterior feature which a skilled person may consider suitable to be used with the present system.

In yet another embodiment, the supporting chair members could be connectable to the vertical frame members instead of the horizontal frame members. In still another embodiment, instead of comprising vertical and horizontal frame members, the frame structure 150 could instead be configured such that the frame members extending in any other orientation when the frame structure 150 is secured to the building structure.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A curtain wall system for a building structure, the system comprising:

a frame structure connectable to an outer perimeter of the building structure, the frame structure including a plurality of frame members secured to each other;

a plurality of wall panels securable to the frame structure side-by-side and parallel to each other so as to define an outer wall for the building structure when the frame structure is connected to the building structure;

a plurality of supporting chair members extending laterally away from each respective frame member of the plurality of frame members towards an exterior of the building structure for receiving a corresponding wall panel of the plurality of wall panels, each supporting chair member of the plurality of supporting chair members being sufficiently rigid for supporting the corresponding wall panel in a cantilevered configuration relative to the respective frame member, each supporting chair member having a proximal side end disposed towards the respective frame member, a distal side end disposed away from the respective frame member and an appendage connector located at the distal side end; and an exterior appendage member having a distal chair connector for engaging the appendage connector of at least one supporting chair member of the plurality of supporting chair members to attach the appendage member to the at least one supporting chair member such that the exterior appendage member extends away from the at least one supporting chair member and towards the exterior of the building structure.

2. The system as claimed in claim 1, further comprising a resilient member extending between the appendage connector of the at least one supporting chair member and the distal chair connector of the exterior appendage member when the appendage connector engages the distal chair connector to urge the appendage connector into engagement with the distal chair connector.

3. The system as claimed in claim 2, wherein the resilient member includes a leaf spring.

4. The system as claimed in claim 2, wherein the appendage connector of the at least one supporting chair member includes a hook portion and the distal chair connector of the exterior appendage includes an inwardly extending recess sidewall defining a hook recess for receiving the hook portion, the resilient member being secured to and extending away from the hook portion to abut and push against the recess sidewall of the distal chair connector when the hook portion is received in the hook recess.

5. The system as claimed in claim 1, wherein the appendage member is selected from a group consisting of: a cap member, a sunshade assembly, a fin and an ornament.

6. The system as claimed in claim 1, wherein the at least one supporting chair member is distinct from the respective frame member and includes a frame connector located at its proximal side end, and further wherein each frame member including a proximal chair connector disposed towards the at least one supporting chair member for engaging the frame connector to attach the at least one supporting chair member to the respective frame member.

7. The system as claimed in claim 6, wherein the respective frame member includes an outer wall facing laterally towards the exterior of the building structure, the proximal chair connector including a receiving groove defined in the outer wall of the respective frame member and extending longitudinally along the respective frame member.

8. The system as claimed in claim 1, wherein each exterior appendage member is removably connected to at least two supporting chair members of the plurality of supporting chair members.

9. The system as claimed in claim 8, wherein the at least two supporting chair members are spaced apart from each other longitudinally along the respective frame member.

10. The system as claimed in claim 1, wherein each supporting chair member includes a proximal chair section disposed towards the respective frame member and a distal chair section disposed away from the respective frame member, the proximal chair section including a first intermediate connector and the distal chair section including a second intermediate connector for engaging the first intermediate connector to attach the proximal chair section to the distal chair section.

11. The system as claimed in claim 10, wherein the first and second intermediate connectors, when engaged together, form a channel therebetween, the channel defining a thermal break between the proximal and distal chair sections.

12. The system as claimed in claim 1, wherein the corresponding wall panel is secured to the respective frame member using an adhesive material provided therebetween.

13. The system as claimed in claim 12, wherein the adhesive material includes a structural silicone sealant.

14. A panel support assembly for a curtain wall system, the curtain wall system including a frame structure having a plurality of spaced-apart frame members, and a plurality of wall panels secured to the frame structure to define an outer wall for a building structure, the assembly comprising:

a plurality of supporting chair members connectable to a each respective frame member of the plurality of frame members of the frame structure so as to extend laterally away from the respective frame member towards an exterior of the building structure, each supporting chair member of the plurality of supporting chair members being sufficiently rigid for receiving and supporting a wall panel of the plurality of wall panels in a cantilevered configuration relative to the respective frame member, each supporting chair member having a proximal side end disposed towards the respective frame member, a distal side end disposed away from the respective frame member and an appendage connector located at the distal side end; and an exterior appendage member having a distal chair connector for engaging the appendage connector of at least one of the supporting chair members to attach the appendage member to the at least one supporting chair member such that the exterior appendage member extends away from the at least one supporting chair member and towards the exterior of the building structure.

15. The assembly as claimed in claim 14, further comprising a resilient member extending between the appendage connector of the at least one supporting chair member and the distal chair connector of the exterior appendage member when the appendage connector engages the distal chair connector to urge the appendage connector into engagement with the distal chair connector.

16. The assembly as claimed in claim 15, wherein the resilient member includes a leaf spring.

17. The assembly as claimed in claim 15, wherein the appendage connector of the at least one supporting chair member includes a hook portion and the distal chair connector of the exterior appendage includes an inwardly extending recess sidewall defining a hook recess for receiving the hook portion, the resilient member being secured to and extending away from the hook portion to abut and push against the recess sidewall of the distal chair connector when the hook portion is received in the hook recess.

18. The assembly as claimed in claim 14, wherein the appendage member is selected from a group consisting of: a cap member, a sunshade assembly, a fin and an ornament.

19. The assembly as claimed in claim 14, wherein each supporting chair member includes a proximal chair section disposed towards the respective frame member and a distal chair section disposed away from the respective frame member, the proximal chair section including a first intermediate connector and the distal chair section including a second intermediate connector for engaging the first intermediate connector to attach the proximal chair section to the distal chair section.

20. The assembly as claimed in claim 19, wherein the first and second intermediate connectors, when engaged together, form a channel therebetween, the channel defining a thermal break between the proximal and distal chair sections.

21. The assembly as claimed in claim 14, wherein the corresponding wall panel is secured to the respective frame member using an adhesive material provided therebetween.

22. The assembly as claimed in claim 21, wherein the adhesive material includes a structural silicone sealant.

23. A curtain wall system for a building structure, the system comprising:

a frame structure including a plurality of spaced-apart frame members, each frame member including a proximal chair connector disposed towards an exterior of the building structure;

a plurality of wall panels secured to the frame structure to define an outer wall for the building structure;

a plurality of supporting chair members extending laterally away from each respective frame member of the plurality of frame members towards an exterior of the building structure for receiving a corresponding wall panel of the plurality of wall panels, each supporting chair member of the plurality of supporting chair members being sufficiently rigid for supporting the corresponding wall panel in a cantilevered configuration relative to the respective frame member, each supporting chair member having a proximal side end disposed towards the respective frame member, a distal side end disposed away from the respective frame member, each supporting chair member further including:

a frame connector located at its proximal side end for engaging the proximal chair connector of the respective frame member to attach each supporting chair member to the respective frame member;

an appendage connector located at the distal side end;

an exterior appendage member having a distal chair connector for engaging the appendage connector of at least one of the supporting chair members of the plurality of supporting chair members to attach the appendage member to the at least one supporting chair member such that the exterior appendage member extends away from the at least one supporting chair member and towards the exterior of the building structure; and a resilient member disposed between the appendage connector and the distal chair connector to urge the appendage connector into engagement with the chair connector.

24. The system as claimed in claim 23, wherein the resilient member includes a leaf spring.

25. The system as claimed in claim 24, wherein the appendage connector includes a hook portion and the distal chair connector includes an inwardly extending recess sidewall defining a hook recess for receiving the hook portion, the resilient member being secured to and extending away from the hook portion to abut and push against the recess sidewall of the distal chair connector when the hook portion is received in the hook recess.

* * * * *